United States Patent [19]

Kohlstette et al.

[11] Patent Number: 4,894,050

[45] Date of Patent: Jan. 16, 1990

[54] STERILE LABORATORY CENTRIFUGE

[75] Inventors: Werner Kohlstette; Ulrich Rotermund, both of Oelde, Fed. Rep. of Germany

[73] Assignee: Westfalia Separtor AG, Oelde, Fed. Rep. of Germany

[21] Appl. No.: 337,499

[22] Filed: Apr. 13, 1989

[30] Foreign Application Priority Data

May 21, 1988 [DE] Fed. Rep. of Germany ..... 3817473

[51] Int. Cl.[4] ..... B04B 11/00

[52] U.S. Cl. ..... 494/30; 494/5

[58] Field of Search ..... 494/38, 40, 35, 56, 494/57, 27, 30, 1, 2, 3, 4, 5, 6; 210/781, 782, 360.1; 422/72

[56] References Cited

U.S. PATENT DOCUMENTS

| | | | |
|---|---|---|---|
| 3,011,647 | 12/1961 | Elsken | 494/30 |
| 3,201,036 | 8/1965 | Halbach | 494/30 |
| 4,505,700 | 3/1985 | Zettier | 494/27 |

*Primary Examiner*—Robert W. Jenkins

*Attorney, Agent, or Firm*—Sprung, Horn, Kramer & Woods

[57] ABSTRACT

A centrifuge, preferably a sterile laboratory centrifuge, with an intake channel for the material being centrifuged, a runoff channel for the clear phase, and a drum with a centrifuging space comprising a separation space equipped with a package of disks and a solids. The centrifuge has an initial operation that comprises introducing material to be centrifuged into the separation space and separating the solids from the clear phase, which is followed by another operation that comprises discontinuing the intake of material to be centrifuged and introducing rinse into the drum through the clear-phase runoff channel. A channel that is employed during the initial operation to supply the material to be centrifuged has two sections, between which is accommodated a valve chamber and a valve body, wherein a channel for diverting the solids extends from the periphery of the solids space to the valve chamber, and wherein the valve body is reversed to initiate the second operation, separating the second channel section, which leads from the valve chamber to the separation space, from the first channel section, connecting the solids-diversion channel to the first channel section, and allowing the solids to be extracted through the first channel section.

6 Claims, 2 Drawing Sheets

STERILE LABORATORY CENTRIFUGE

BACKGROUND OF THE INVENTION

The invention concerns a centrifuge, preferably a sterile laboratory centrifuge, with an intake channel for the material being centrifuged, a runoff channel for the clear phase, and a drum with a centrifuging space comprising a separation space equipped with a package of disks and a solids space, whereby an initial operation that comprises introducing material to be centrifuged into the separation space and separating the solids from the clear phase is followed by another operation that comprises discontinuing the intake of material to be centrifuged and introducing rinse into the drum through the clear-phase runoff channel.

A centrifuge of this type is known from Canadian Patent No. 607 737. The heavier phase of the liquid is conveyed to a runoff from the separation space by way of an annular channel during the initial operation. During the second operation, when the supply of material to be centrifuged to the drum is discontinued, rinse is introduced into the clear-phase runoff channel to clean the package of disks, the solids space, and the other components inside the drum. The rinse is then removed from inside the drum by way of the heavier liquid-phase runoff.

SUMMARY OF THE INVENTION

The object of the invention is to improve a centrifuge of the aforesaid type to the extent that operation subject to sterile conditions is facilitated by reducing the number of incoming and outgoing lines and that high concentrations of solids can be achieved.

This object is attained in accordance with the invention by the improvement wherein a channel that is employed during the initial operation to supply the material to be centrifuged has two sections between which is accommodated a valve chamber and a valve body, wherein a channel for diverting the solids extends from the periphery of the solids space to the valve chamber, and wherein the valve body is reversed to initiate the second operation, separating the second channel section, which leads from the valve chamber to the separation space, from the first channel section, connecting the solids-diversion channel to the first channel section, and allowing the solids to be extracted through the first channel section.

The channel that is employed in the centrifuge in accordance with the invention to supply the material to be centrifuged during the first operation is employed during the second operation to extract the solids, which are expelled from the solids space by the rinse without the rinse mixing with the solids. The rinse is introduced into the centrifuging space through the channel that is employed during the first operation as a runoff for the clear phase. The solids are obtained from the centrifuge at high concentrations. The clear phase can also be exploited as a rinse.

Since it has no separate runoff for the solids, the centrifuge is relatively simple in design.

In one advantageous embodiment of the centrifuge in accordance with the invention, the valve body is reversed to initiate the first or the second operation by the pressure of the material being conveyed to the drum during the particular operation in progress.

The valve body can have a central channel and slide back and forth on a nipple with a central bore that communicates with the solids-diversion channel.

The channel through the center of the valve body can taper down toward the upper face of the valve body.

The first section of the intake channel can open into the valve chamber in the vicinity of its upper inner surface during the first operation, the valve body can, when it is in its upper limiting position, rest against the upper inner surface of the valve chamber, and the second channel section can extend from the bottom of the valve body to a distribution chamber.

The solids space can be in the form of a double cone.

BRIEF DESCRIPTION OF THE DRAWINGS

The invention will now be described in greater detail with reference to the drawings, wherein.

DETAILED DESCRIPTION OF THE INVENTION

Figure 2:
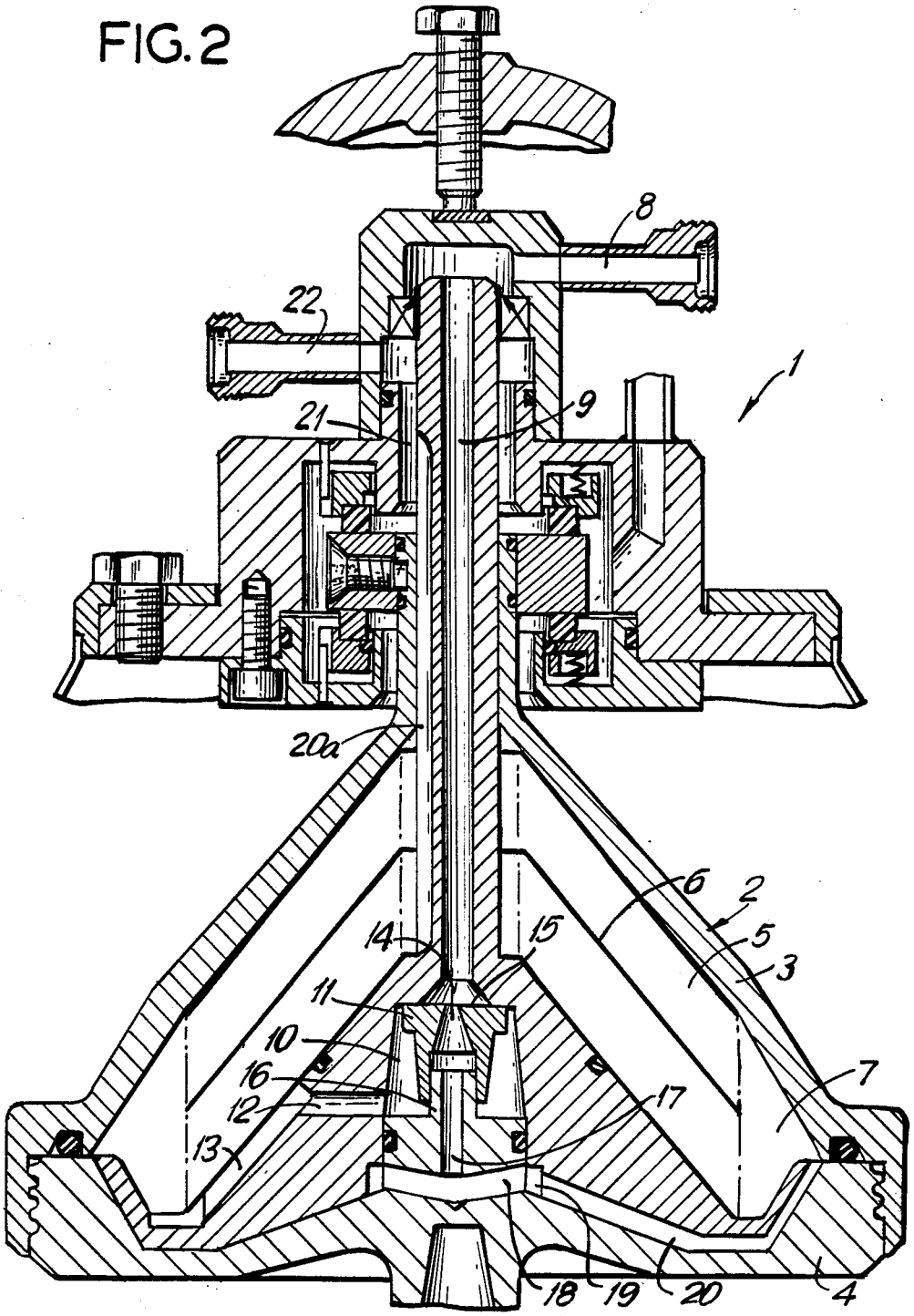

A centrifuge 1 has a drum 2 that consists of a lid 3 and a base 4 that screw together to produce a centrifuging space comprising a separation space 5 and a solids space 7 that is, as will be evident from FIG. 2, shaped like a double cone. Separation space 5 accommodates a package 6 of disks.

During the first operation of the centrifuge, when material supplied to the drum to be centrifuged is separated, the material is introduced through a connection 8 and, since it forces a valve body 11 that slides up and down inside a valve chamber 10 into its lower limiting position, arrives in the valve chamber by way of one section 9 of an intake channel. The material flows from valve chamber 10 by way of another section 12 of the intake channel into a distribution chamber 13, whence it arrives in separation space 5.

A channel 14 extends through the center of valve body 11 and, in the illustrated embodiment, tapers down to the upper face 15 of the valve body. The valve body slides up and down on a nipple 16 that has a bore 17 extending through its center. The bore communicates through at least one branch 18 with an annular channel 19. A solids-diversion channel 20 extends from the periphery of solids space 7 into annular channel 19.

Although the first section 9 of the intake channel communicates with solids space 7 through channel 14, bore 17, channels 18 and 19, and solids-diversion channel 20, once the material to be centrifuged has forced valve body 11 down into its lower limiting position, will flow from first section 9, through valve chamber 10 and second channel section 12, and into the separation space because that route offers less impedance.

During the first or separating operation, the solids will accumulate in solids space 7 at a high concentration.

The clear phase will be conveyed to a runoff line 22 through a channel **20*a* inside the centrifuge and through an annular space 21. When a valve 23 is opened, the clear phase will arrive in a container 24**.

Figure 1:
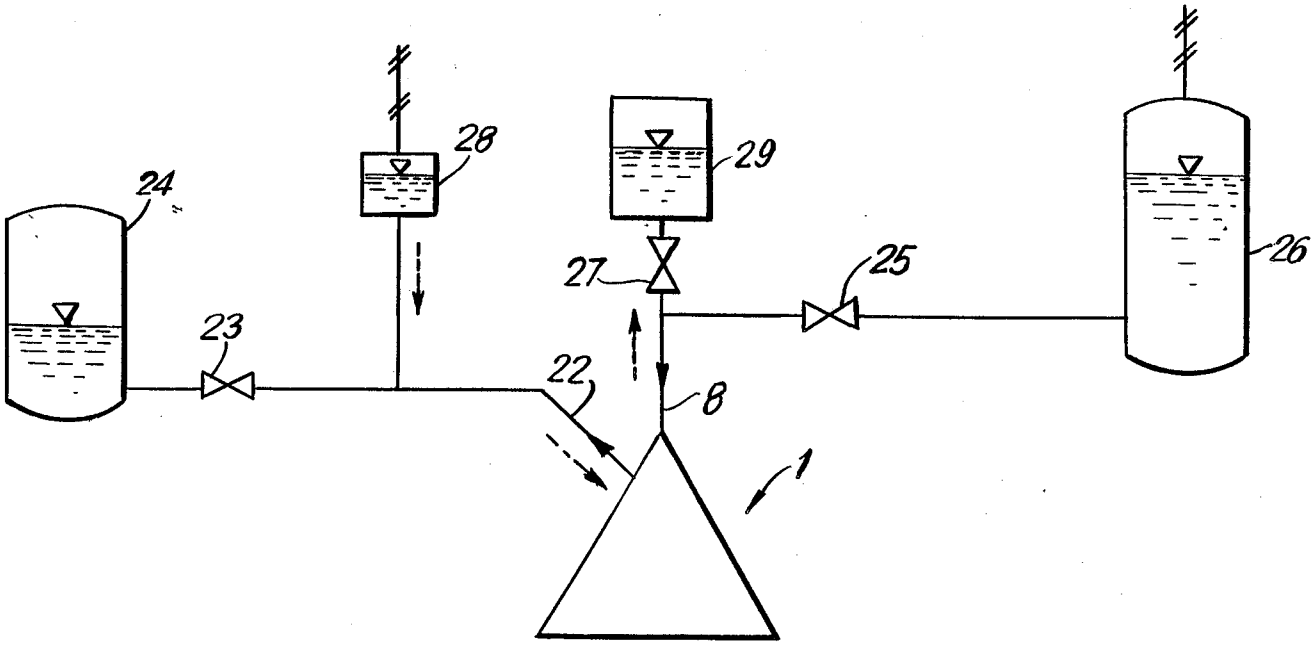
FIG. 1 is a schematic illustration of a centrifuge that operates under sterile conditions and FIG. 2 is a vertical section through the centrifuge illustrated in FIG. 1.

The continuous-line arrows in FIG. 1 indicate the direction the liquid flows in during the first operation.

When a valve 25 is open, the material to be centrifuged will flow out of a container 26, in which it is subjected to sterile compressed air, to connection 8. Another valve 27 is closed during this operation.

Once the centrifugate has been separated, the operation is reversed by closing valves 23 and 25 and opening valve 27.

Rinse is now supplied to centrifuge 1 from a container 28 by way of the channel 22 employed during the first operation as a runoff line for the clear phase. The rinse will be conveyed from separation space 5, through the distribution chamber and second channel section 12, and into valve chamber 10, forcing valve body 11 into the position illustrated in FIG. 2. In this upper limiting position, the upper face of the valve body rests against the upper inner surface of valve chamber 10, where first channel section 9 opens into the chamber. In its upper limiting position, valve body 11 interrupts the communication between second channel section 12 and first channel section 9, so that the rinse supplied to the rotating drum will force the solids out of solids space 7 and extract it from the centrifuge through solids-diversion channel 20, channels 18 and 19, bore 17, channel 14, first channel section 9, and connection 8. The solids will retain their high concentration. The rinse constitutes a column of liquid that applies pressure to the solids. The solids are removed from container 29. The routes of the liquid and solids during the second operation, when the centrifuge is emptied, are indicated by the discontinuous-line arrows in FIG. 1.

The centrifuge can be employed to gently centrifuge bacterial or shear-sensitive cells under sterile conditions. Both the liquid and the solids are supplied and extracted within a closed system.

It will be appreciated that the instant specifications and claims are set forth by way of illustration and not limitation, and that various modifications and changes may be made without departing from the spirit and scope of the present invention.

What is claimed is:

1. In a centrifuge, having an intake channel for material being centrifuged, a runoff channel for a clear phase, and a drum with a centrifuging space comprising a separation space having a package of disks and a solids space, means for effecting an initial operation wherein material to be centrifuged is introduced into the separation space and solids are separated from the clear phase followed by another operation that wherein intake of material to be centrifuged is discontinued and rinse is introduced into the drum through the clear-phase runoff channel, the improvement wherein the means for effecting the initial and another operations comprises the intake channel for supplying material to be centrifuged during the initial operation having two sections, a valve chamber between the two channel sections, a channel for diverting solids and extending from a periphery of the solids space to the valve chamber, and a valve body slidably received in the valve chamber and movable between a first position during the initial operation wherein the two channel sections are in communication and the solids-diversion channel is closed and a second position to initiate the second operation wherein one channel section which leads from the valve chamber to the separation space, is separated from the other channel section and connect the solids-diversion channel is connected to the other channel section, to allow solids to be extracted through the other channel section.

2. The centrifuge as in claim 1, wherein the valve body has means responsive to the pressure of material being conveyed to the drum during the each operation to move same between the first and second positions.

3. The centrifuge as in claim 1, wherein the valve body has a central channel and slides on a nipple with a central bore that communicates with the solids-diversion channel.

4. The centrifuge as in claim 3, wherein the channel through the center of the valve body tapers down toward the upper face of the valve body.

5. The centrifuge as in claim 1, wherein the other section of the intake channel opens into the valve chamber in the vicinity of an upper inner surface during the initial operation, wherein the valve body, when it is in its first position, rests against the upper inner surface of the valve chamber, and wherein the one channel section can extend from a bottom of the valve body to a distribution chamber.

6. The centrifuge as in claim 1, wherein the solids space is in the form of a double cone.

* * * * *